US006435459B1

(12) United States Patent
Sanderson et al.

(10) Patent No.: US 6,435,459 B1
(45) Date of Patent: Aug. 20, 2002

(54) LED WAYSIDE SIGNAL FOR A RAILWAY

(75) Inventors: John Richard Sanderson, Oakland Park, FL (US); Klaus Oesterheld, Middletown; Rand Eikelberger, Allenwood, both of NJ (US)

(73) Assignee: Dialight Corporation, Manasquan, NJ (US)

( * ) Notice: Subject to any disclaimer, the term of this patent is extended or adjusted under 35 U.S.C. 154(b) by 0 days.

(21) Appl. No.: 09/429,351

(22) Filed: Oct. 28, 1999

(51) Int. Cl.[7] ..... B61L 29/24
(52) U.S. Cl. ..... 246/473.3; 246/477
(58) Field of Search ..... 246/1 R, 1 C, 246/473.1, 473.3, 477, 478

(56) References Cited

U.S. PATENT DOCUMENTS

| | | | | | |
|---|---|---|---|---|---|
| 3,085,238 | A | * | 4/1963 | Lewis | 246/473.1 |
| 3,544,960 | A | * | 12/1970 | Hayes | 246/473.3 |
| 3,576,563 | A | * | 4/1971 | Scott et al. | 340/380 |
| 5,325,271 | A | * | 6/1994 | Hutchinsson | 362/32 |
| 5,634,287 | A | * | 6/1997 | Lamparter | 40/572 |
| 6,039,291 | A | * | 3/2000 | Dobson, IV | 246/219 |
| 6,152,590 | A | * | 11/2000 | Furst et al. | 362/545 |

* cited by examiner

*Primary Examiner*—S. Joseph Morano
*Assistant Examiner*—Robert J. McCarry, Jr.
(74) *Attorney, Agent, or Firm*—Oblon, Spivak, McClelland, Maier & Neustadt, P.C.

(57) ABSTRACT

A wayside signal for a railway includes a plurality of light emitting diodes housed in a housing. The light emitting diodes output indication signals. Further, the light emitting diodes are configured on a first circuit board which is thermally coupled to the housing. The housing may also include heat sink fins to dissipate heat generated by the light emitting diodes and associated driving circuitry for driving the light emitting diodes also contained within the housing. An additional light emitting diode may also be contained within the housing to point in an opposite direction than the indication signal light emitting diodes, which additional light emitting diode may be formed on a second circuit board with the driving circuitry. The additional light emitting diode provides an indication to anyone behind the wayside signal as to the indication of the wayside signal. The wayside signal is further optimized for thermal efficiency and to be sealed against the elements. In regard to thermal efficiency, the first circuit board may be metal clad and the housing may be formed of black anodized aluminum. Also, a plastic insulator may be attached to the housing and covered with a lamp base. The lamp base may be configured to be inserted into a conventional socket for a wayside signal, so that the wayside signal of the present invention can be utilized with existing circuitry.

12 Claims, 3 Drawing Sheets

LED WAYSIDE SIGNAL FOR A RAILWAY

BACKGROUND OF THE INVENTION

1. Field of the Invention

The present invention is directed to an LED (light emitting diode) lamp which finds particular use as a wayside signal for a railway.

2. Discussion of the Background

The railroad industry utilizes wayside signals to indicate authorization for trains to proceed or to stop at certain positions on railroad tracks. Currently, such wayside signals utilize incandescent lamps to provide the indication for the train to proceed or not.

However, the use of incandescent lamps in the wayside signals results in certain drawbacks. First, the life of incandescent lamps is relatively short, i.e., an incandescent lamp typically burns out in a relatively short period of time of approximately 6 to 12 months. This may be particularly problematic in wayside signals for railways as such wayside signals may often be placed at remote locations along railroad tracks. As a result, it is often inconvenient and time consuming for maintenance personnel to replace a burned out wayside signal. Also, any time a wayside signal burns out safety concerns are raised and the use of certain railroad track sections may be prohibited, resulting in a loss of operating efficiency, requiring track reroutings, etc. A further drawback with wayside signals utilizing incandescent lamps is that they are relatively energy inefficient.

SUMMARY OF THE INVENTION

Accordingly, one object of the present invention is to provide a novel wayside signal for a railway which can overcome the drawbacks in conventional wayside signals.

A further object of the present invention is to provide a novel wayside signal for a railway which results in reduced maintenance costs and increases energy efficiency in comparison with conventional wayside signals utilizing incandescent light bulbs.

A further object of the present invention is to provide a novel wayside signal for a railway which provides the above-noted benefits without sacrificing operating performance and reliability.

To achieve the above-noted and other objects, the present invention is directed to a novel wayside signal for a railway which includes a plurality of light emitting diodes housed in a housing. The light emitting diodes output the indication signals. Further, the light emitting diodes are configured on a first circuit board which is thermally coupled to the housing. The housing may also include heat sink fins to dissipate heat generated by the light emitting diodes and associated driving circuitry for driving the light emitting diodes also contained within the housing. An additional light emitting diode may also be contained within the housing to point in an opposite direction than the indication signal light emitting diodes, which additional light emitting diode may be formed on a second circuit board with the driving circuitry. The additional light emitting diode provides an indication to anyone behind the wayside signal as to the indication of the wayside signal.

As a further feature in the present invention, the wayside signal is optimized for thermal efficiency and to be sealed against the elements. In regard to thermal efficiency, the first circuit board may be metal clad and the housing may be made of die cast aluminum and black anodized.

As a further feature in the present invention, a plastic insulator may be attached to the housing onto which a lamp base may be swaged. Further, the wayside signal of the present invention can be utilized with existing wayside signal sockets and circuitry.

BRIEF DESCRIPTION OF THE DRAWINGS

A more complete appreciation of the present invention and many of the attendant advantages thereof will be readily obtained as the same becomes better understood by reference to the following, detailed description when considered in connection with the accompanying dr s, wherein.

DESCRIPTION OF THE REFERRED EMBODIMENTS

Figure 1:
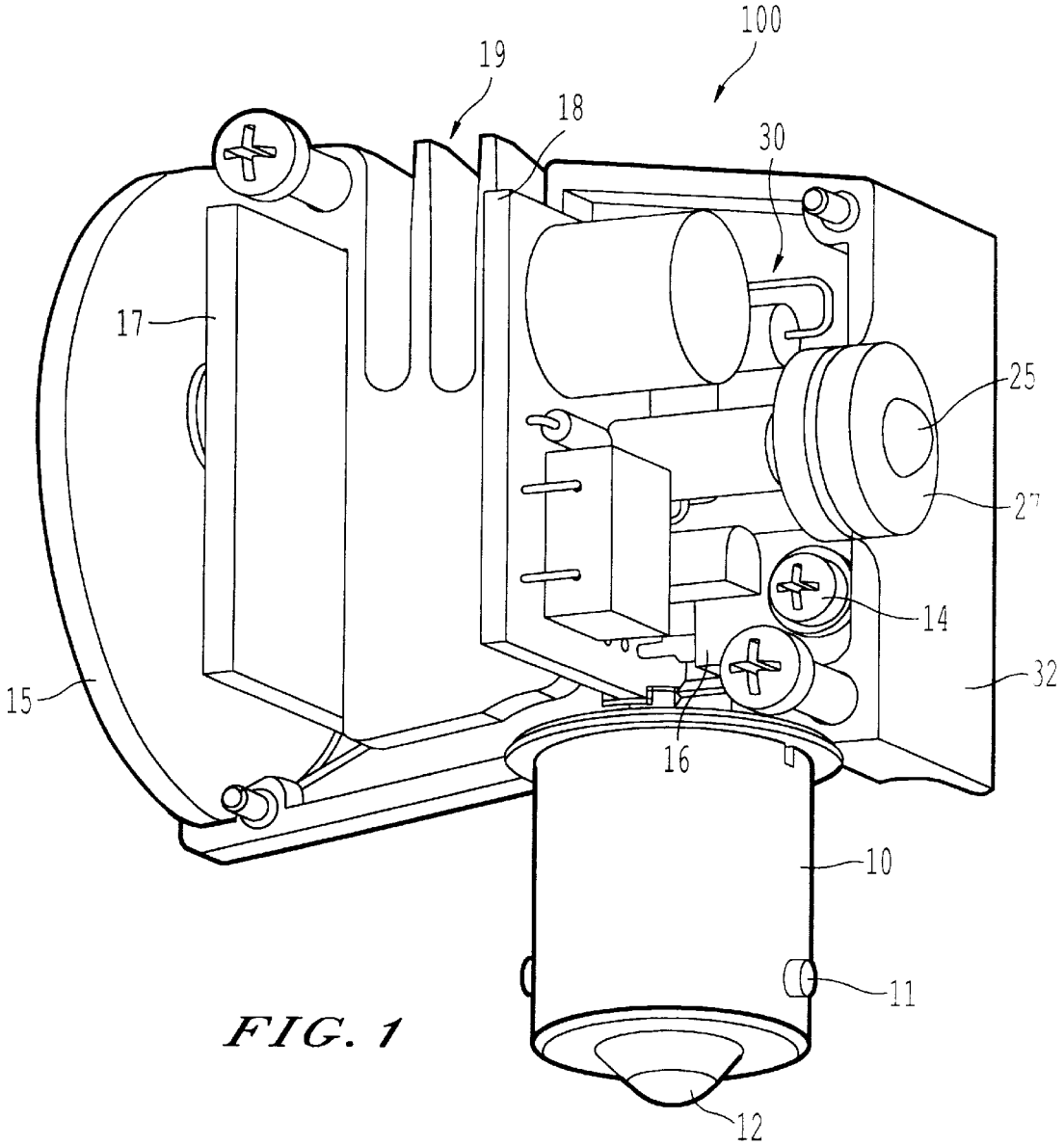
FIG. 1 shows a perspective view of the left half of the wayside signal housing of the present invent.
Figure 2:
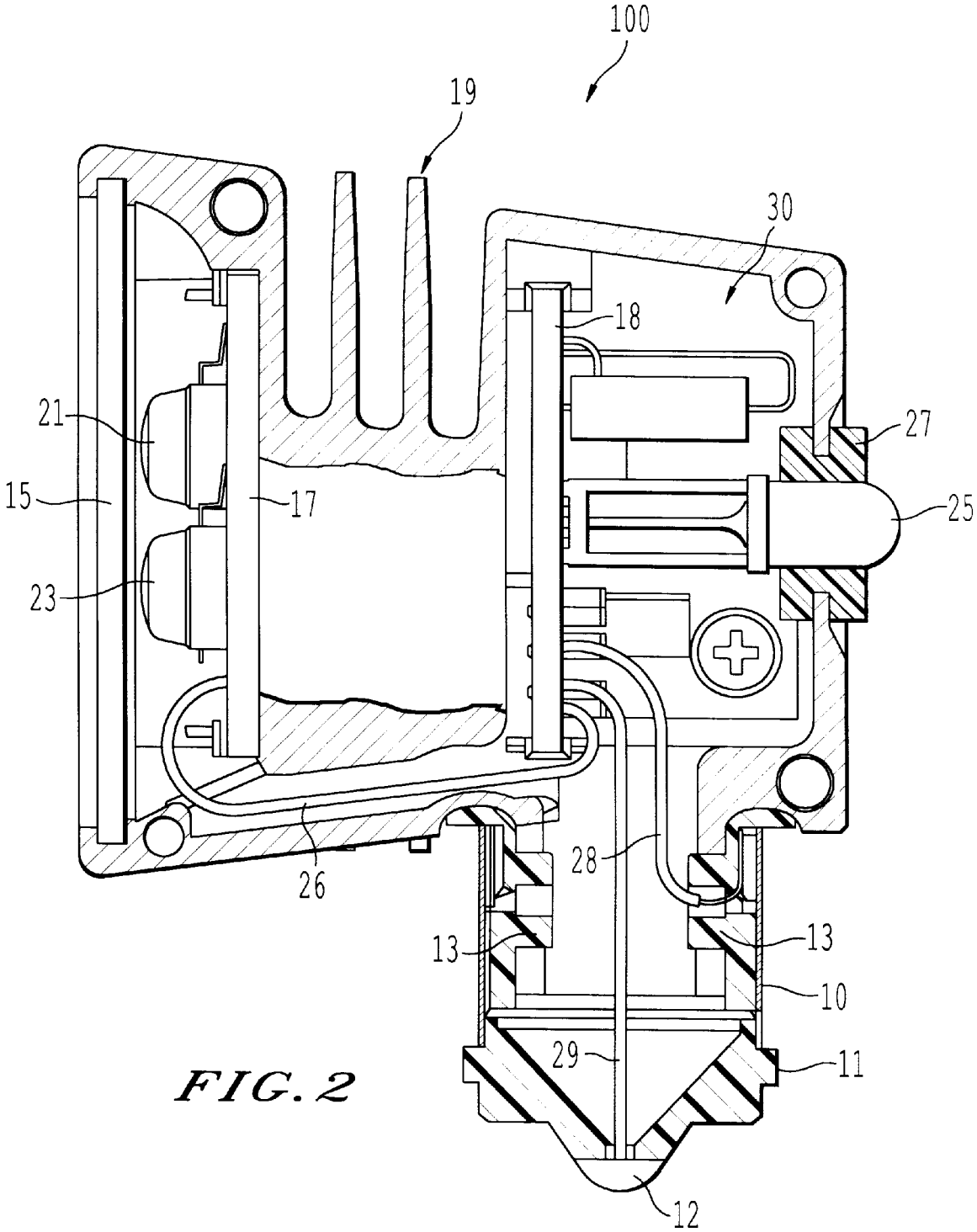
FIG. 2 shows a side cut-out view of the wayside signal of the present invention.

Referring now to the drawings, wherein like reference numerals designate identical or corresponding parts throughout the several views, and more particularly to FIGS. 1 and 2 thereof, perspective internal and cut-out side views of the wayside signal of the present invention are provided.

As shown in FIGS. 1 and 2, the wayside signal 100 of the present invention includes a front lens 15 which covers two LED elements 21 and 23. FIGS. 1 and 2 show two LED elements 21 and 23, although different numbers of LED elements may be used. The LED elements 21 and 23 may be of the same or different colors. For example, the LED elements 21, 23 may each be red LEDs. As one possible alternative, multiple color LEDs could be utilized. As an example, red and yellow LEDs could be utilized to obtain an orange output light, or reverse mounted green and red LEDs may be utilized such that the green LED is opposite a forward mounted red LED so that by applying a voltage of a first polarity to the LEDs the LEDs output the color red and by applying a reverse polarity to the LEDs the LEDs output the color green. Obviously other possibilities for the colors of the LED elements in the wayside signal 100 of the present invention are possible.

LED's 21, 23 are utilized as the light generating elements in the wayside signal 100 of the present invention for the following reasons. First, LED's are significantly more energy efficient than incandescent light bulbs, and thus the wayside signal 100 of the present invention is significantly more energy efficient than a conventional wayside signal utilizing an incandescent lamp. Secondly, LED's have significantly longer lifetimes than incandescent lamps. Whereas an incandescent lamp typically has a lifetime of anywhere between 6 to 18 months, an LED typically has a lifetime anywhere between 5 to 10 years. Thus, maintenance costs in replacing the wayside signal 100 of the present invention can be significantly reduced as such wayside signal 100 burns out, and thus has to be replaced, less frequently than conventional wayside signals utilizing incandescent lamps. That also provides safety and operating efficiency benefits. However, utilizing LED's as the light emitting elements does provide certain issues which must be addressed, particularly with respect to thermal dissipation.

In FIGS. 1 and 2, the front lens 15 is essentially a window and does not have any optical power, although it is possible to use a lens which collimates or spreads out light if desired. The front lens 15 is provided snugly in the housing of the wayside signal 100 so that the wayside signal 100 is amply sealed against moisture, dirt, debris, mishandling, insects, etc. As shown most clearly in FIG. 3B, the housing of the wayside signal 100 of the present invention includes two housing halves or portions 31, 32 which form an overall housing. FIG. 1 shows the wayside signal 100 with the housing portion 31 removed to provide a view of the internal elements in the wayside signal 100.

The LED's 21, 23 are mounted on the circuit board 17. The circuit board 17 may be a metal clad printed circuit board which is thermally bonded to the housing portions 31, 32. The metal clad printed circuit board 17 is connected by wire 26 to a further circuit board 18. The circuit board 18 may be a conventional glass epoxy circuit board. Driving circuitry 30 for driving the LED's 21, 23 is provided on the glass epoxy circuit board 18. Thus, the glass epoxy circuit board 18 provides a mount for conventional driving circuit elements such as a full-wave bridge rectifier, filtering capacitors, a transient voltage suppressor, current limiting resistors, etc. The driving circuitry 30 mounted on the glass epoxy circuit board 18 may provide a regulated current source, temperature compensation, etc. to maintain a constant light output of the LED's 21 and 23, although other driving circuitry features can be implemented in the drive circuitry 30.

The LED's 21, 23 may be high power LED's, such as those manufactured by Hewlett Packard under the name BARRACUDA. One concern with utilizing LED's 21, 23 as a light source in the wayside signal 100 is that LED's generate a significant amount of heat and are also heat dependent elements, i.e., as an LED becomes hotter its light output diminishes. As a result, thermal considerations are addressed in the present invention. More specifically, one reason that the circuit board 17 on which the LED's 21, 23 are mounted may be metal clad is for heat dissipation properties. Further, the metal clad circuit board 17 is thermally bonded to the housing portions 31, 32. Further, the housing portions 31, 32 include heat sink fins 19 provided directly behind the metal clad circuit board 17. The heat sink fins 19 assist in dissipating heat generated by the LED's 21, 23 and the driving circuitry 30.

A further feature in the present invention is that an additional LED 25 may be provided to face and emit light in an opposite direction than the LED's 21, 23, i.e., the LED 25 emits light in a rearward direction. That additional LED 25 is provided for the benefit of any workers who may be around the wayside signal 100 so that they can know what indication is being provided by the LED's 21, 23. That is, with the rearward facing LED 25 workers behind the wayside signal 100 will know whether the wayside signal 100 is providing an indication for a train to proceed or to not proceed.

Further, the rearward facing LED 25 is mounted on the glass epoxy circuit board 18 and receives power therefrom. The rearward facing LED 25 need not be a high power BARRACUDA LED, but can be a moderate power LED. Further, the rearward facing LED 25 may be mounted within a rubber grommet 27 to help the overall sealing of the wayward signal 100, and to keep moisture away from the driving circuitry 30.

Also attached to the housing portions 31, 32 is a metal lamp base 10. The lamp base 10 is designed to be inserted into a conventional wayside signal lamp socket so that the wayside signal 100 of the present invention can be easily utilized in an existing wayside signal socket. Further, extending below the plastic housing base 10 is an electrical contact point 12 which makes electrical connection with the power source within the socket of a conventional wayside signal. The electrical contact point 12 is connected to the glass epoxy circuit board 18, and thus the driving circuitry 30 thereof, by connecting wire 29.

As a further feature in the present invention an insulator 13, see FIG. 2, formed of a plastic material may be provided to insulate the housing portions 31, 32 from the existing socket into which the wayside signal 100 is to be inserted. The plastic insulator 13 is formed in the lamp base 10 to be between the lamp base 10 and the housing portions 31, 32 and may be of sufficient thickness to provide breakdown isolation to approximately 2000 volts.

The glass epoxy circuit board 18 also includes a wire 28 which is soldered to lamp base 10 to serve as a connection to the return power lead.

Further, the lamp base 10 includes bayonet connectors 11 to connect with the conventional wayside signal socket, although other connectors, such as a screw base connector, could be utilized. The bayonet connectors 11 are positioned such that when the wayside signal 100 is placed in a proper position in an existing wayside signal socket, the lens 15 is facing in a forward direction.

Figure 3A:
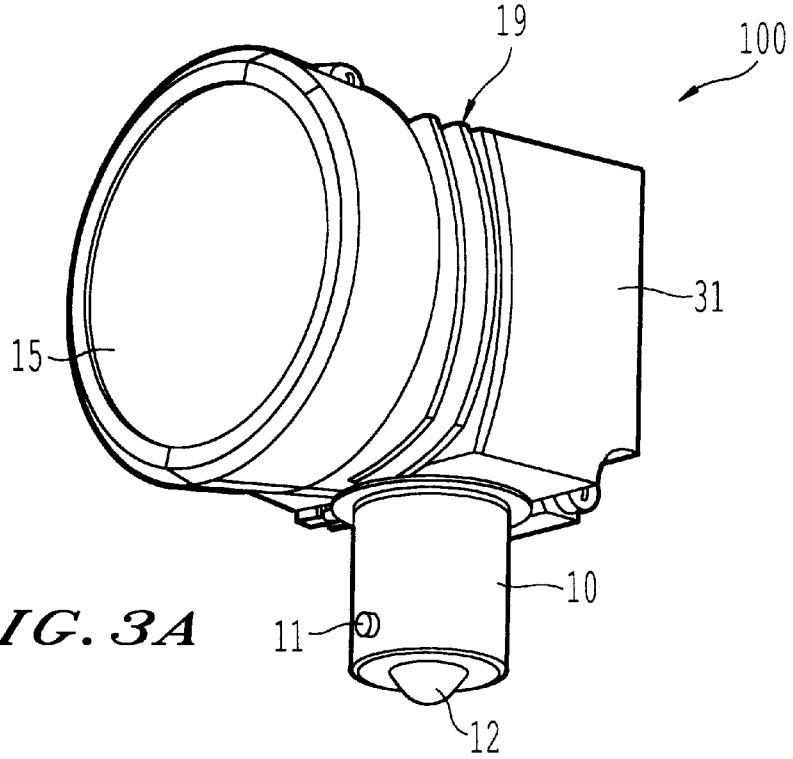
FIGS. 3A and 3B show perspective external views of the wayside signal of the present invention.
Figure 3B:
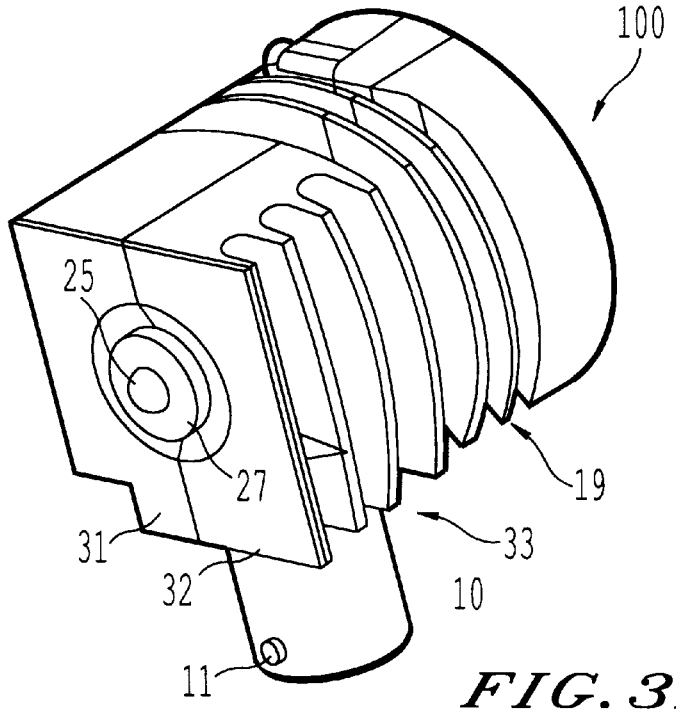

As shown most clearly in FIGS. 3A 3B, both housing portions 31 and 32 include the heat sink fins 19. Further, the housing portion 32 also includes additional heat sink fins 33. The use of both of such heat sink fins 19, 33 provides good thermal operation properties for the wayside signal 100. Further, both housing portions 31, 32 may be formed of die cast black anodized aluminum to maximize heat flow and minimize electrical conductivity. The heat sink fins 19, 33 are particularly provided behind the respective circuit board 17 and 18 to dissipate heat therefrom and maximize their operation. The two housing portions 31, 32 can also be easily attached by various screws, see FIG. 1. If heat sinking properties are not particularly needed, the two housing portions 31, 32 may be formed of plastic, to reduce costs. A further possible material that the two housing portions 31, 32 can be made of is a plastic under the name KONDUIT™, developed by LNP Engineering Plastics, which material is thermally conductive, but less so than metal.

The present invention may also include, as shown in FIG. 1, the screw 14 and a further heat sinking element 16 placed on the circuit board and housed in the housing portions 31, 32. The heat sinking element 16 may be an npn transistor, a resistor, etc. The screw 14 may be provided to affix the heat sinking element 16 and the insulator 13 to the housing portions 31, 32.

With such a structure of a wayside signal 100 as in the present invention, a wayside signal which is both energy efficient and which has a long lifetime, and which thereby has to be replaced less often than a conventional wayside signal utilizing an incandescent lightbulb, can be realized. Further, the wayside signal 100 of the present invention can be easily utilized in an existing wayside signal socket. The wayside signal 100 of the present invention also provides efficient heat sinking properties, and is well sealed against moisture, dirt, debris, mishandling, insects, etc.

Obviously, numerous additional modifications and variations of the present invention are possible in light of the above teachings. It is therefore to be understood that within the scope of the appended claims, the present invention may be practiced otherwise than as specifically described herein.

What is claimed is:

1. A wayside signal for a railway comprising:

(a) a housing;

(b) at least one first light emitting diode housed in said housing and configured to output at least one indication signal; and (c) a first circuit board on which said at least one first light emitting diode is mounted, said first circuit board being thermally coupled to said housing; and (d) a second circuit board containing drive circuitry for driving said at least one first light emitting diode.

2. A wayside signal for a railway according to claim 1, further comprising (e) heat sink fins mounted on said housing and positioned between said first and second circuit boards.

3. A wayside signal for a railway according to claim 1, further comprising (e) at least one second light emitting diode mounted on said second circuit board and configured to emit light in an opposite direction as said at least one first light emitting diode.

4. A wayside signal for a railway according to claim 1, wherein said first circuit board is metal clad.

5. A wayside signal for a railway according to claim 1, wherein said housing is formed of die cast black anodized aluminum.

6. A wayside signal for a railway according to claim 1, further comprising (e) a lamp base and (f) an insulator attached between said housing and lamp base, said lamp base being configured to be inserted into a socket.

7. A wayside signal for a railway according to claim 6, wherein said lamp base includes a bayonet connection to be inserted into the socket.

8. A wayside signal for a railway according to claim 1, wherein said first circuit board is metal clad and said second circuit board is formed of glass epoxy.

9. A wayside signal for a railway comprising:

(a) housing means for housing various elements;

(b) first light emitting means housed in said housing means for outputting at least one indication signal;

(c) first support means for supporting said first light emitting means, said first support means being thermally coupled to said housing means; and (d) second support means for supporting drive circuitry for driving said first light emitting means.

10. A wayside signal for a railway according to claim 9, further comprising (e) heat dissipating means mounted on said housing means between said first and second support means for dissipating heat generated in said housing means.

11. A wayside signal for a railway according to claim 9, further comprising (e) second light emitting means mounted on said second support means for emitting light in an opposite direction as said first light emitting means.

12. A wayside signal for a railway according to claim 9, further comprising (e) connecting means attached to said housing means for connecting said wayside signal into a socket.

* * * * *